United States Patent [19]

Mauger

[11] Patent Number: 4,934,070

[45] Date of Patent: Jun. 19, 1990

[54] SHOE SOLE OR INSOLE WITH CIRCULATION OF AN INCORPORATED FLUID

[76] Inventor: Jean Mauger, 7 rue des Saulniers, 44350 Guerande, France

[21] Appl. No.: 321,882

[22] Filed: Mar. 10, 1989

[30] Foreign Application Priority Data

Mar. 28, 1988 [FR] France ..... 88 04026

[51] Int. Cl.[5] ..... A43B 13/38

[52] U.S. Cl. ..... 36/28; 36/25 R; 36/43; 36/44

[58] Field of Search ..... 36/28, 29, 43, 71, 44; 128/594

[56] References Cited

U.S. PATENT DOCUMENTS

| | | | |
|---|---|---|---|
| 3,871,117 | 3/1975 | Richmond et al. | 36/29 |
| 4,123,855 | 11/1978 | Thedford | 36/29 |
| 4,451,994 | 6/1984 | Fowler | 36/28 |
| 4,567,677 | 2/1986 | Zona | 36/28 |
| 4,802,289 | 2/1989 | Guldager | 36/44 |

FOREIGN PATENT DOCUMENTS

| | | | |
|---|---|---|---|
| 0095357 | 11/1983 | European Pat. Off. . | |
| 2428357 | 2/1975 | Fed. Rep. of Germany . | |
| 2508779 | 7/1981 | France | 36/29 |
| 2591441 | 6/1987 | France . | |

*Primary Examiner*—Paul T. Sewell
*Assistant Examiner*—Andrew O. Meyers
*Attorney, Agent, or Firm*—Young & Thompson

[57] ABSTRACT

The present invention relates to a shoe sole or insole with circulation of an incorporated fluid, in which the upper surface of the shoe sole forms a chamber which is crushable under the pressure of the foot, said chamber being subdivided by slanting transverse blades having their edge independent of the deformable sheet closing said chamber and forming the lower surface of the shoe sole, this chamber communicating at the front and rear ends of the shoe sole with a chamber formed on the upper surface and closed in a tight manner by a thin sheet, both chambers being filled with a fluid, said thin sheets being welded at their periphery to the surface of a said peripheral edge.

According to the invention, the upper surface of said peripheral edge is connected to the upper surface of the separating plate by a slanting surface, and the side of said blade is rigidly connected to the neighbouring slanting surface of said peripheral shoulder by a thinned-out portion having a width which is substantially equal to the height of said blade.

The invention provides for an improved massage effect of the sole of the foot.

4 Claims, 1 Drawing Sheet

SHOE SOLE OR INSOLE WITH CIRCULATION OF AN INCORPORATED FLUID

FIELD OF THE INVENTION

The present invention relates to a shoe sole or insole with circulation of an incorporated fluid of the type disclosed in FR-A-2 591 441 in which the lower surface of the sole forms a crushable chamber under the pressure of the foot bearing on said sole, said chamber being subdivided by slanting transverse blades the edge of which is independant of the deformable sheet or plate closing said chamber and forming the lower surface of the sole, said chamber communicating at the front and rear ends of the sole with a chamber formed on the upper surface of the sole and closed in a tight manner by a thin sheet or plate, both chambers being filled with a fluid.

BACKGROUND OF THE INVENTION

In the sole disclosed in FR-A-2 91 441, the edges of the blades of the lower chamber protrude above the lower plane of the peripheral shoulder, the thin sheet closing the lower chamber being, at rest, inflated in its central portion above the edges of the blades. On the other hand, the upper chamber is also provided with slanting blades the edge of which is independant of the deformable thin sheet or plate which closes said upper chamber, these blades being inclined in the reverse direction to those of the lower chamber.

In practice, it has proved that the fluid circulation in the upper chamber in contact with the sole of the foot, which circulation provides for the massage effect which is desired with this type of shoe sole, was broken by the blades provided in this chamber since said blades were stretched taut between the two sides of the peripheral shoulder and were bearing over their whole length against the thin closing sheet, which sheet is in turn stretched taut inside the frame formed by the shoulder. Moreover, the upper surface of the peripheral shoulder is connected to the plate forming the separation between the upper and lower chambers by a surface reached by the blades, which is perpendicular to said upper surface and to said plate. When the flexible sheet is being welded on the shoulder upper surface, the welding flows above the chamber and forms an enlargement of a few millimeters, thereby reducing the active surface of the shoe sole in contact with the sole of the foot, and proves unconfortable for the user. Moreover, when the peripheral shoulder of the thin sheet is being welded on the upper or lower narrow plane surface of the shoulder, it has proved difficult to obtain a safe tight welding.

In order to remedy the braking of the fluid circulation due to the action of the rigidity of the stretched blades, it has been imagined to make the side of the blades independent from the shoulder by forming a thin slot between the shoulder and the end thereof which is connected to the blade. However, the effect of this slot can be cancelled by a point of glue between the welding enlargement of the flexible sheet on the peripheral shoulder surface and the blade edge. If the independence of the blade with respect to the shoulder is maintained, the fluid follows a preferential passage of lesser resistance opposite the slot, thereby reducing the fluid circulation in the central portion where the contact with the sole of the foot is maximum.

OBJECTS AND SUMMARY OF THE INVENTION

The object of the present invention is to remedy these disadvantages. According to the invention, the upper surface of the peripheral shoulder is connected to the upper surface of the separating plate by a slanting surface. With this embodiment, the welding enlargement is offset sideways, thereby increasing the surface of the flexible sheet which is in contact with the sole of the foot.

In order to obtain a perfectly tight welding between the upper or lower surface of the peripheral shoulder and the thin closing sheet of the chamber, said surface of the shoulder is being given a convex section. With this characteristic, the convex central portion of the shoulder surface is resiliently crushed, thereby providing for a better heat seal in the central portion of the band along which the welding is effected.

According to another feature, the side of one blade of the upper chamber is rigidly connected to the neighbouring slanting surface of the peripheral shoulder by a thinned-out portion having a width which is substantially equal to the height of the blade. This characteristic eliminates the rigidity of the blade which was braking the fluid circulation and preserves nevertheless the continuity of the barrier formed by each blade, which causes the fluid to flow preferably in the central portion where the contact between the upper flexible sheet and the sole of the foot is mainly effected.

Finally, the filling with liquid of the upper and lower chambers of the shoe sole is effected through an opening extending through the edge, preferably in alignement with the rear chamber provided for setting the lower and upper chambers in mutual communication, and after filling, said opening is closed by a plug.

BRIEF DESCRIPTION OF DRAWINGS

The invention will be described in more detail hereafter by way of a preferential embodiment, with reference to the accompanying drawings wherein.

DETAILED DESCRIPTION OF THE INVENTION

Figure 3:
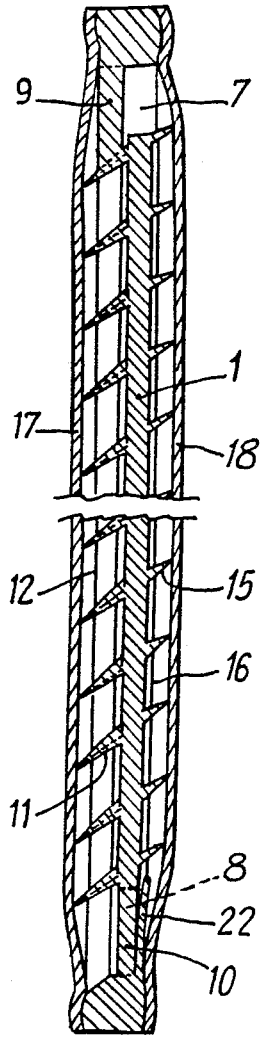
FIG. 3 is a partial longitudinal sectional view.
Figure 1:
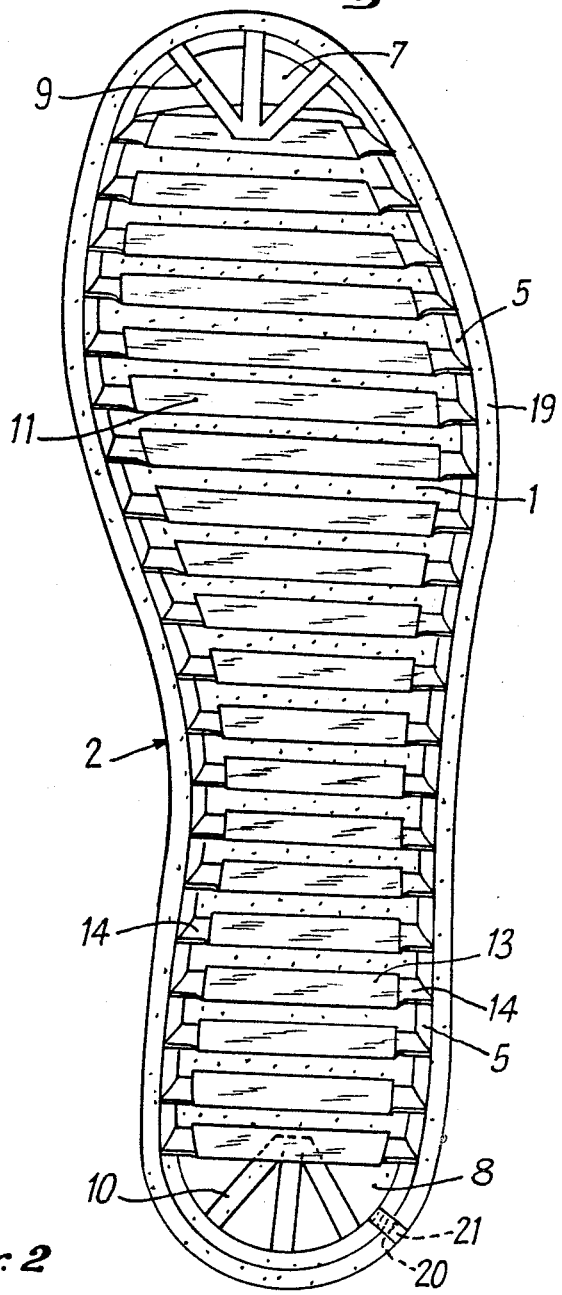
FIG. 1 is a plan view of the shoe sole upper surface, with the flexible sheet removed.
Figure 2:
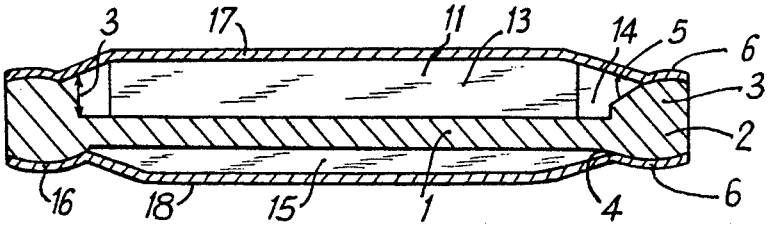
FIG. 2 is a transverse sectional view thereof.

In the drawings, reference 1 denotes the plate forming the body of the shoe sole which is surrounded by a peripheral shoulder 2. On the upper face of body 1, the peripheral shoulder is protruding at 3 with respect to said face over a height which is far superior to height 4 of the same peripheral shoulder with respect to the lower face. According to the present invention, the inner edge of the peripheral shoulder 3 which is protruding on the upper face is chamfered at 5. The upper and lower surfaces 6 of the peripheral shoulder 2 are bulging.

Body 1 is interrupted in front in order to create, between it and the peripheral shoulder 2, an intercommunication window 7 between the upper and lower chambers, and the same applies to the rear where there is formed a window 8. Bars 9–10 are provided in windows 7 and 8 for avoiding any deformation of the peripheral shoulder 2 around said windows under the effect of the setting under pressure of the fluid filling the inner space of the shoe sole, a fluid which is set in circulation for effecting a massage of the sole of the foot.

The upper face of body 1 is fitted out with blades 11 which are slanting rearwardly, with their free edge slightly extending beyond the plane of the peripheral shoulder 12 forming the upper surface of shoulder 2.

According to the present invention, blades 11 have a central portion 13 of triangular section providing the blade with a resilient return force to its form of origin when not compressed and the two ends of the blade are connected to the peripheral shoulder 3 and to its chamfered portion 5 by a thinner web 14 having a width substantially equal to the height of blade 11.

The lower face of the body is fitted out with blades 15 having their edge protruding in a more pronounced way than blades 11 with respect to the lower surface 16 of the peripheral shoulder 2.

Two thin sheets 17 and 18, respectively for the upper surface and for the lower surface, are placed above blades 11–15 and welded at their periphery on the faces 6 of the peripheral shoulder 2. As regards the upper thin sheet 17, this sheet is welded only on the bulging surface 19 remaining at the periphery of chamfer 5, and the welding enlargement which is likely to be produced along the edges of the welding zones is limited to within the angle between said chamfer 5 and the thin sheet 17. Therefore, it does not reduce the active surface of the upper face of the shoe sole which, with the specific shape of blades 11, is facing the edges of the portions 13 of the blades. Surfaces 6 on which the thin sheets 17 and 18 are rigidly connected by a heat seal to shoulder 2 being bulging, the pressure which is created at the center of the welding seam is higher than along the edges of the seam due to the compressibility of the material forming shoulder 2, and there is therefore obtained a more resilient and more tight welding. The whole volume comprised between the two sheets and the peripheral shoulder 2 is filled with a compressible or incompressible fluid, preferably an aqueous mixture containing a bactericide, an antifungal or similar. This fluid is introduced, once the shoe sole is completed, via an orifice 20 formed in shoulder 2 and opening into the chamber formed by window 8. This orifice 20 is then closed by a plug 21.

When the sole is applied under pressure on the ground via its lower surface formed of sheet 18, the blades 15 are crushed and the fluid under pressure which is between two blades is expelled toward the chamber situated more in front and thus, by degrees, up to window 7 from where it flows into the chamber of the upper surface. The portions of the upper chamber which are at the level of the heel and of the metatarsal zone are compressed and the liquid enclosed therein between blades 11 is, due to the slant of the blades, expelled toward the rear portion of the shoe sole, blades 11 preventing its being driven frontwardly. On the other hand, the liquid flows between the edges of the blades 11 situated rearwardly with respect to the pressure zone and the upper thin sheet 17 closing the shoe sole upper inner space, by flexing portion 13 of blades 11 rearwardly, webs 14 opposing the liquid flow along shoulder 2 while imparting to portion 13 a possibility of a high flexure due to their inherent thinness. This provides for an intense circulation of the liquid, this circulation being, with the hereabove described characteristics of the blades 11, concentrated in the central zone of the shoe sole facing the edges of the thick portions 13 of blades 11.

In order to still improve the operation of the shoe sole, it is possible to prevent the countercurrent flow of the fluid by forming, in windows 7 and 8, check valves such as blade 22 which closes window 8 by coming to bear on the lower face of bars 10 and the shoulder of body 1 in order to oppose the fluid return upwardly from the lower chamber to the upper chamber.

I claim:

1. A shoe sole or insole with circulation of an incorporated fluid in which a lower surface of a sole forms a crushable chamber under the pressure of the foot bearing on said sold, a deformable sheet closing said chamber and forming the lower surface of the shoe sole, said chamber being subdivided by transverse lower slating blades having edges which are independent of said deformable sheet, a separating plate bearing said lower blades, said chamber communicating at the front and rear ends of the shoe sole with a chamber formed on the upper surface of the separating plate and closed tightly by a thin sheet, upper blades on said upper surface of the separating plate, both chambers being filled with a fluid, the thin sheets being welded at their periphery to a peripheral shoulder on said separating plate, the upper surface of said peripheral shoulder being connected to the upper surface of the separating plate by a slanting surface, the side of said upper blades being connected to the neighboring slanting surface of said peripheral edge via a thinned-out portion having a width which is substantially equal to the height of said blade.

2. A shoe sole or insole according to claim 1, wherein the upper or lower surface of said peripheral shoulder is of a convex section.

3. A shoe sole or insole according to claim 1, and a check valve mounted in at least one of a pair of windows communicating between the upper and lower chambers for opposing fluid countercurrent circulation.

4. A shoe sole or insole according to claim 1, wherein the filling with fluid or said upper and lower chambers of the shoe sole is effected via an orifice extending through said shoulder, and said orifice is closed by a plug after filling.

* * * * *